US006006452A

United States Patent [19]

Bonaventure

[11] Patent Number: 6,006,452

[45] Date of Patent: Dec. 28, 1999

[54] BOOT WITH FORCE TRANSMISSION REINFORCEMENT

[75] Inventor: Laurent Bonaventure, Cran-Gevrier, France

[73] Assignee: Salomon S.A., Metz-Tessy, France

[21] Appl. No.: 08/805,882

[22] Filed: Mar. 3, 1997

[30] Foreign Application Priority Data

Mar. 4, 1996 [FR] France ..... 96 02863

[51] Int. Cl.[6] ..... A43B 5/04

[52] U.S. Cl. ..... 36/118.8; 36/118.2

[58] Field of Search ..... 36/118.2, 118.3, 36/118.4, 118.7, 118.8, 119.1

[56] References Cited

U.S. PATENT DOCUMENTS

| | | | |
|---|---|---|---|
| 4,756,099 | 7/1988 | Walkhoff | 36/118.8 |
| 5,001,850 | 3/1991 | Mattiuzzo | 36/118.8 |
| 5,031,341 | 7/1991 | Paris et al. | 36/118.2 X |
| 5,033,210 | 7/1991 | Dodge et al. | 36/118.8 |
| 5,046,269 | 9/1991 | Pozzobon | 36/118.3 |
| 5,203,098 | 4/1993 | Perrissoud et al. | 36/118.8 X |
| 5,461,802 | 10/1995 | Paris et al. | 36/118.2 X |

FOREIGN PATENT DOCUMENTS

| | | |
|---|---|---|
| 0630591 | 12/1994 | European Pat. Off. . |
| 0645101 | 3/1995 | European Pat. Off. . |
| 2063555 | 7/1971 | France . |
| 2663820 | 1/1992 | France . |
| 1921907 | 8/1965 | Germany . |
| 456393 | 7/1968 | Switzerland . |
| 507673 | 7/1971 | Switzerland . |

*Primary Examiner*—B. Dayoan
*Attorney, Agent, or Firm*—Greenblum & Bernstein P.L.C.

[57] ABSTRACT

A sport boot with an upper and a shell base journalled on axles has at least one reinforcement element of the shell base. The reinforcement element has an abutment zone capable of cooperating with a retractable support element which, fixedly positioned on the upper, makes it possible to block the upper in its pivoting about axles as early as its initial position or after a certain bending, and to thus transmit the forces of the upper to the shell base.

20 Claims, 3 Drawing Sheets

BOOT WITH FORCE TRANSMISSION REINFORCEMENT

BACKGROUND OF THE INVENTION

1. Field of the Invention

The present invention relates to a sport boot having an upper and a shell base journalled to one another about journal axles, and whose shell base is reinforced by at least one reinforcement element of its wall. The invention also relates to the limitation of pivoting of the upper on its journal axles with respect to the reinforced shell base, as well as to the transmission of the forces of the upper on the shell base when it is within the pivoting limit.

2. Background and Material Information

Known sport boots, such as the ski boots described in the documents DE 19 21 907, CH 507 673, and CH 456 393, have reinforcement elements inserted in the wall of the shell base that are adapted to protect the flasks thereof, and some of which are adapted to provide it with further stiffness in predetermined areas. In these boots, the reinforcement elements have no influence either in the transmission of the forces or supports applied on the upper, or on the pivoting possibilities of the latter with respect to the shell base.

Other known sport boots, such as those described in the documents FR 2 063 555, EP 630 591, and EP 645 101, have an upper and a shell base, provided with a sole, which are connected and journalled to one another about journal axles in the zone corresponding to the joint of the wearer's ankle where they are joined by an at least partial overlapping on one another, via the lower edge of the upper and a collar of the shell base. Reinforcement elements are inserted in the wall of the shell base and of the upper, and are adapted, in addition to stiffening these portions of the boot, to transmit the supports or forces of the upper toward the shell base by means of the journal axles these portions. Indeed, these reinforcement elements arranged on the upper and the shell base are connected to one another solely by means of journal axles. Because of this, the forces or supports applied on the boot upper by the wearer in the transverse direction thereof, or vertically, are transmitted with relatively no power loss on the flanks of the boot toward the sole. These reinforcement elements make it possible to reach an optimum flexibility-rigidity compromise for the boot by positioning flexible portions in the location of the adjustment zones and rigid portions in the location of the zones for transmitting the impulses and supports of the wearer. However, they are inoperative in limiting the possible pivoting of the upper with respect to the shell base about its journal axles, and are therefore also inoperative in transmitting a force in the direction of the forward or rearward pivoting of the upper.

SUMMARY OF THE INVENTION

An object of the present invention, in boots of the aforementioned type, is to use at least one reinforcement element of the wall of the shell base and/or of the upper to limit the pivoting of the latter about its journal axles, and to transmit the forces that are applied thereto, especially in the direction of its pivoting on the shell base, in a preferred direction determined by the shape and contour of the reinforcement element, as well as by its location on the flank of the shell base and that of its abutment zone with respect to the journal axles of the upper.

Another object of the invention is to distribute the forces coming from the upper over a relatively substantial surface and contour of the reinforcement element in order to decrease the pressures and stresses that may be capable of exceeding, on overly localized points, the mechanical strength of the constituent materials or elements of the wall of the shell base and/or of the upper.

To achieve this object, the sport boot according to the invention has an upper and a shell base, provided with a sole, that are connected and journalled to one another about journal axles located in the zone corresponding to the joint of the wearer's ankle, for example, at the level of the malleoli or of the heel, where they join one another by an at least partial overlapping on one another, via the lower edge of the upper and a collar of the shell base, and includes at least one reinforcement element inserted in the wall of the shell base which extends from the collar thereof toward the sole. The sport boot is characterized in that the reinforcement element of the shell base has an abutment zone located beneath the lower edge of the upper, the latter being provided, in correspondence with this abutment zone, with a retractable support element which, fixedly positioned on the upper, is capable of cooperating through a profiled end with the abutment zone in order to block the upper in its pivoting movement about its journal axles.

Thus designed, the boot according to the invention can, on the one hand, be obtained with wall structures constituted in "multiple materials" or "multiple components" such as described in the document EP 645 101, which makes it possible, among others, to optimize the zones to be reinforced and those to be maintained flexible, and on the other hand, the boot can be provided with a flexional stiffness or flexibility due to the use or non-use of the retractable support element.

Furthermore, the retractable support element cooperating directly with the abutment zone located on the reinforcement element, the forces or stresses that are applied to its contact point and which can be very substantial, are transmitted and distributed over the entire surface and the contour of the reinforcement element inserted in the wall of the shell base, and can therefore be brought back to a level that does not exceed the mechanical strength of the components or constituent material of the wall, which is most often made of plastic material.

Moreover, the forces transmitted from the upper on the shell base, when it is within the pivoting limit or blocked, can easily be deviated and/or oriented in a preferred direction along the shape and contour of the reinforcement element. Likewise, according to the location of the reinforcement element on the flank of the shell base and that of its abutment zone with resect to journal axles of the upper, the forces transmitted by the upper can also be oriented in a selected constant direction.

According to a preferred embodiment of the invention, at least one reinforcement element is inserted in the wall of the boot upper, in the area where the retractable support element is located. In this way, the forces and/or pressures intervening between the upper and the shell base are supported from one reinforcement element to another. In a way, the coupling of the reinforcement elements is carried out, i.e., they are caused to function together.

BRIEF DESCRIPTION OF DRAWINGS

The invention will be better understood, together with the description that follows, with reference to the annexed drawings which show, by way of example, a plurality of embodiments of sport boots provided therewith, and in which.

DETAILED DESCRIPTION OF THE PREFERRED EMBODIMENTS

Figure 1:
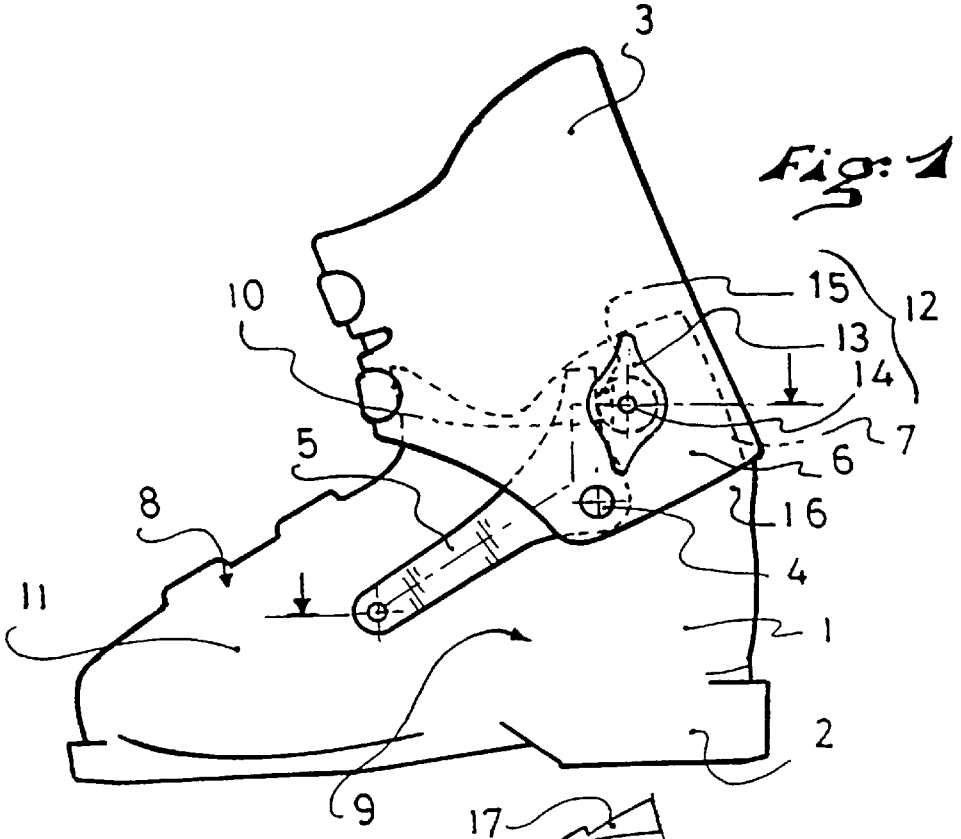
FIGS. 1 and 2 schematically show a ski boot whose upper is journalled in the malleolar zone, provided with an element for reinforcement and transmission of the active forces during the forward pivoting of the boot.
Figure 2:
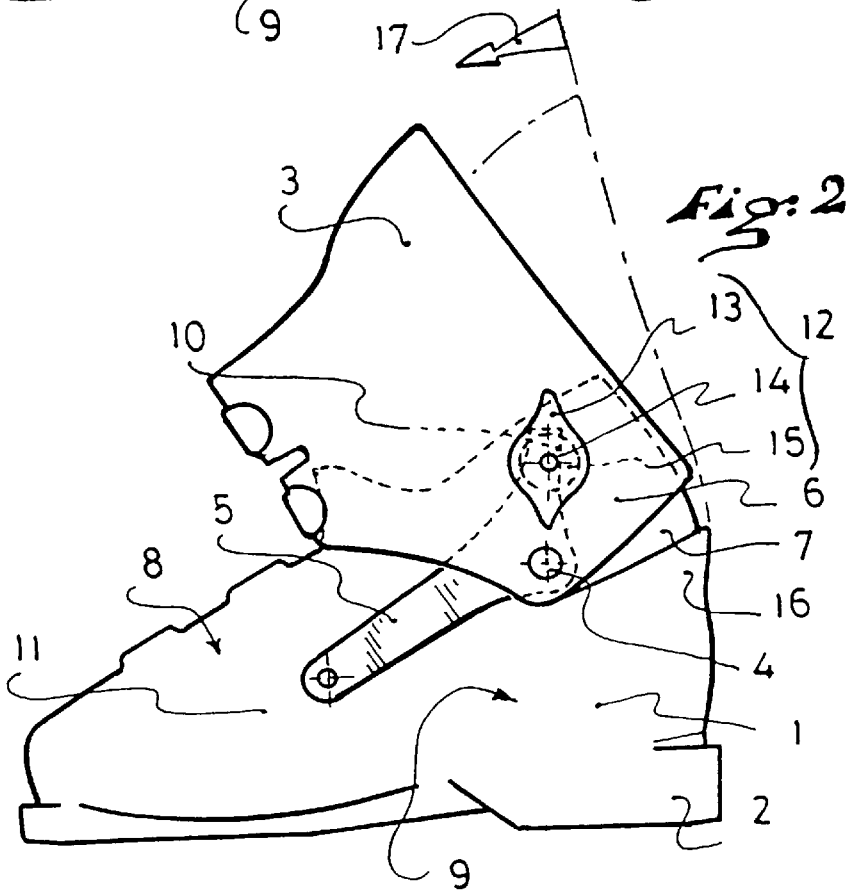

FIGS. 1 and 2 show a sport boot, such as a ski boot, having a shell base 1 provided with a sole 2, and an upper 3 preferably pivotally mounted on the shell base 1 by means of journal axles 4 located, in this example, in the zone corresponding to the wearer's malleoli. The upper 3 and the shell base 1 are joined by nesting on one another via the lower edge 6 of the upper 3 which covers a collar 7 of the shell base 1. An elongated reinforcement element 5 is inserted in the wall of the shell base 1 on the side of the inner flank 9 thereof, and extends thereon from the collar 7 toward the tip 11 of the shell base 1, by passing through the corresponding journal axle 4. This reinforcement element 5 makes it possible to optimize the flexibility and the rigidity that are desired in certain areas of the boot; for example, the top portion 8 of the shell base 1 must remain flexible to enable its adjustment on the wearer's instep, whereas the inner flank 9 must be relatively rigid in order to transmit to the skis, with a maximum of power, at least the lateral supports of the skier's leg that are applied on the upper 3.

Figure 3:
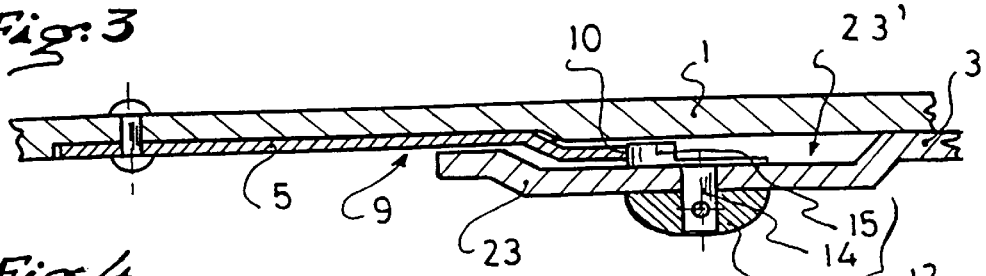
FIGS. 3, 4 and 5 show a cross-sectional view, along the line III—III of FIG. 1, of the reinforcement and transmission element with the support element of the upper according to a first embodiment, FIGS. 3 and 4, where the abutment zone of the reinforcement element is projecting from the reinforced wall, and according to a second embodiment, FIG. 5, where the abutment zone of the reinforcement element is included in the thickness of the reinforced wall.
Figure 4:
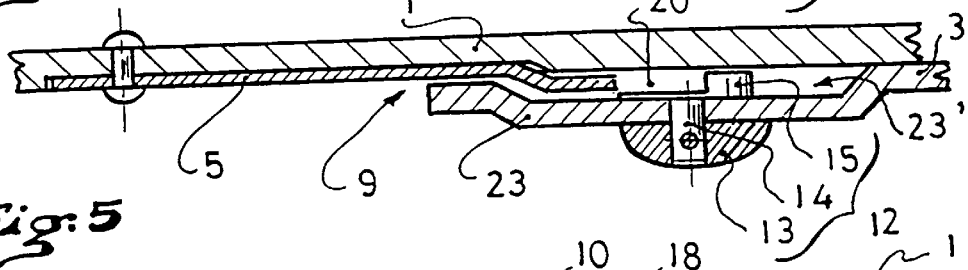

According to a characteristic of the invention, shown more in detail in FIGS. 3 and 4, the reinforcement element 5 has an abutment zone 10, located beneath the lower edge 6 of the upper 3, and the latter is provided with a corresponding retractable support element 12.

The retractable support element, fixedly positioned on the upper 3, is constituted by a rotating button 13, substantially perpendicular to the reinforced wall of the shell base 1, and includes a cylindrical portion 14 whose end is profiled by a shoulder 15.

In this embodiment, the abutment zone 10 of the reinforcement element 5 is oriented opposite the forward pivoting of the upper 3, and projects from the reinforced wall, substantially for the thickness value of the element 5, toward the outside of the shell base 1, for example, its inner flank 9.

Figure 5:
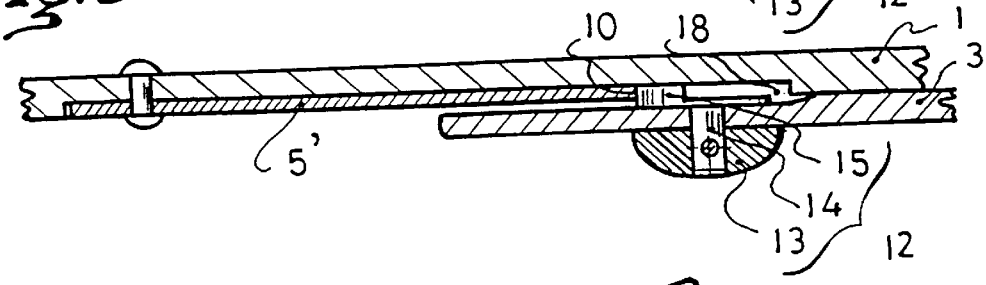

Of course, as illustrated in FIG. 5, the abutment zone 10 of the reinforcement element 5' can be included in the thickness of the wall of the shell base 1. A housing 18 is then provided in the wall opposite the abutment zone 10, and is sized to freely receive the profiled end 15 of the support element 12 which must be capable of rotating therein, at least to pass from its position for cooperation with the abutment zone 10 to its retracted position with respect thereto.

Across from the abutment zone 10, the wall of the upper 3 is obtained with a curvature 23 constituting a cavity 23' in which the abutment zone 10 and the profiled end 15 constituted by the shoulder of the support element 12 are housed.

In a first position visible in FIGS. 1 and 3, the support element 12 is turned such that its shoulder 15 is already in contact with the abutment zone 10 of the reinforcement element 5 when the upper 3 of the boot is in its initial position, i.e., when its edge 6 is in support on the rear abutment 16 obtained in correspondence on the shell base 1.

In this position, the upper 3 is then prevented from any rear and front pivoting on its journal axles 4 due to the rear abutment 16 of the shell base, and to the abutment zone 10 of the reinforcement element 5. As a result of this blockage, the boot acquires a certain flexional stiffness that is desired for competition skiing where it is necessary to ensure the transmission of the skier's impulses applied on the upper 3 in as short a period as possible and without any loss of power, i.e., with a minimum of dampening.

In a second position, visible in FIGS. 2 and 4, the support element 12 is rotated by 180° with respect to the first position, and its shoulder 15 is thus spaced from the abutment zone 10 by the offset value indicated by the reference numeral 20 (FIG. 4). Thus, the support element 12 is retracted from the abutment zone 10 and can no longer cooperate therewith, unless the boot upper 3 pivots sufficiently in forward bending to bring its shoulder 15 back into contact therewith, as is visible and indicated in FIG. 2 by the arrow 17. The separation of the shoulder 15 with respect to the abutment zone 10 in the initial position of the upper 3 therefore makes it possible to benefit from a certain dampening resulting from the elastic deformation of the portions of the upper 3 and of the shell base 1 that overlap one another, for the offset value of the shoulder 15, before recovering a blockage or pivoting limit. This forward flexional flexibility before the blockage is generally desired for leisure-recreational skiing where the emphasis is placed more on comfort-shock absorption than quickness, responsiveness and power.

The reinforcement element 5 thus integrated into the boot makes it possible to design the latter from a "multiple material" or "multiple component" wall structure, and to modify the bending behavior of the boot depending on the intended sport. It also makes it possible, in view of its extent on the wall and/or the flank of the shell base 1, to distribute the forces or stresses that are applied to the contact point between the shoulder 15 and the abutment zone 10 over its entire surface and its contour inserted in the wall. Therefore, by suitably sizing the reinforcement element 5, these forces or stresses can be brought back to a level that does not exceed the mechanical strength of the components or of the constituent material of the wall.

Of course, the reinforcement element can be inserted in the wall of the shell base 1 by any known process, such as adhesion, duplicate molding, riveting, etc.

Furthermore, the reinforcement element 5 can advantageously be utilized such that the forces or stresses to which it is subject are further oriented in a preferred direction. For this, its shape, contour, location on the flank of the shell base 1, as well as that of its abutment zone 10 with respect to the journal axles 4 and to the support element 12, can be originally adapted so that the forces transmitted by the upper 3 by means of the support element 12 are directed on the shell base 1 in a predetermined constant direction.

Thus, in the example of FIGS. 1–4, the reinforcement element 5 has an elongated shape which extends toward the front 11 of the shell base 1 well beyond the journal axle 4 which is also maintained by the element 5, whereas its abutment zone 10 is positioned substantially perpendicular to the axle 4. With this arrangement, the forces applied on the upper 3 and which cause its forward bending are supported by the support element 12 as soon as it comes into contact with the abutment zone 10 of the reinforcement element 5, therefore at a higher level than the axle 4 of the upper 3, and are transmitted to the element 5 which diffuses them over its entire surface and its contour, up to the front 11 of the shell base 1, in particular. The reinforcement element 5 thereby constitutes the equivalent of a force directional transmitter between the upper 3 and the shell base 1.

Figure 6:
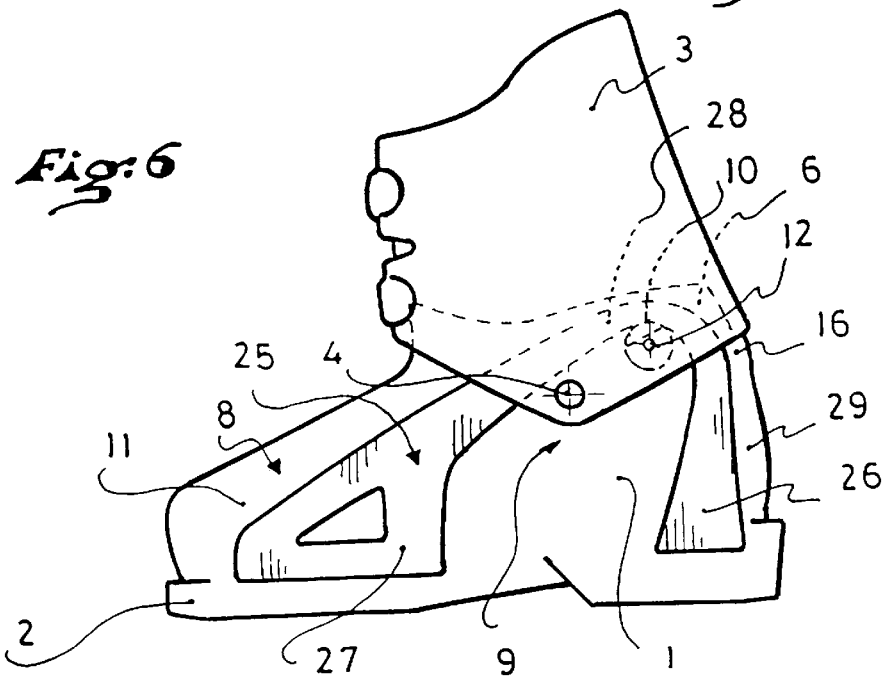
FIG. 6 shows another embodiment of the shape of the reinforcement and transmission element.

It is obvious that the reinforcement element 5, 5', can be obtained in various forms and located in other areas than those that have just been described. Thus, in the example shown in FIG. 6, the reinforcement element 25 substantially has the configuration of a inverted "U" one arm 26 of which extends vertically in the heel zone 29 of the shell base 1, whereas the other arm 27 extends toward the front 11 of the shell base 1, the median portion 28 of the inverted "U" extends, over the top, around the journal axle 4 of the upper 3 on the shell base 1, and is provided with the abutment zone 10, projecting from or included in the thickness of the wall of the shell base, with which the support element 12 is adapted to cooperate.

Figure 7:
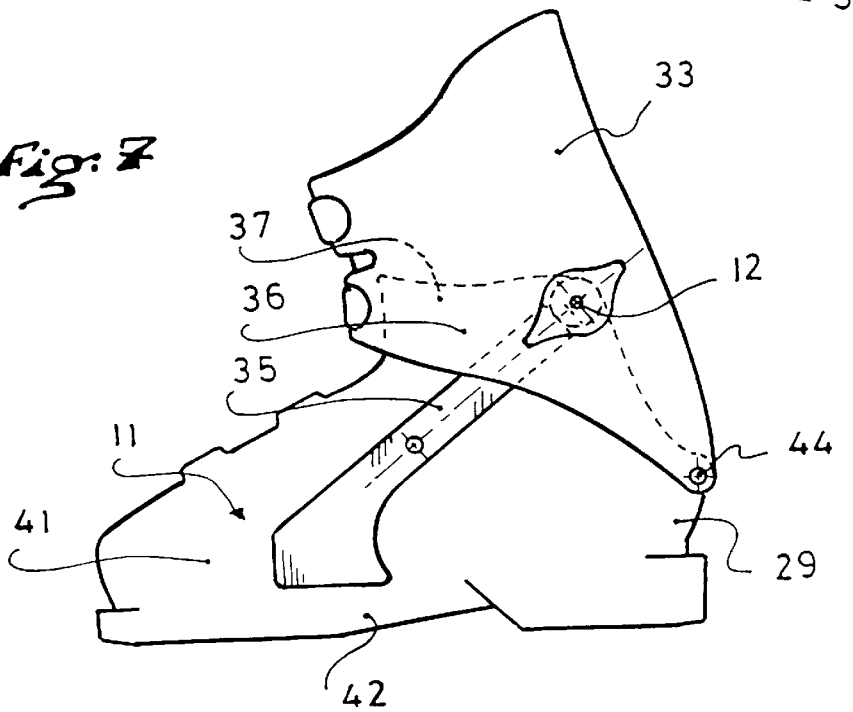
FIG. 7 shows a boot whose upper is journalled in the heel zone, and whose reinforcement and transmission element extends longitudinally opposite the forward pivoting of the upper.

In FIG. 7, the reinforcement element 35 is elongated and obliquely extends along the flank of the boot, from the collar 37 of the shell base 41, approximately at the level of the malleolar zone, up to the front 11 thereof.

As described previously, the collar 37 is covered at least partially by the lower edge 36 of the upper 33. On the contrary, the upper 33, in this construction mode for the boot, is journalled on axles 44 arranged in the heel zone 29 of the shell base 41, whereas the support means 12 is located in the zone corresponding to the malleoli. With this arrangement, the reinforcement element 35 is oriented through its larger length opposite the direction of forward pivoting the upper 33. Consequently, the forces or stresses applied on the upper 33 in this direction are practically transmitted in the longitudinal direction of the reinforcement element 35 toward the front 11 of the shell base 41 and its sole 42. As described previously, the abutment zone 10 can be provided to be either projecting from or included in the thickness of the wall of the shell base.

The examples of construction which have just been described with reference to FIGS. 1–7 situate the abutment zone 10 of the reinforcement element 5, 5', in cooperation with the profiled end 15 of the support element 12 only during the pivoting of the upper 3, 33, in forward bending of the boot.

Figure 8:
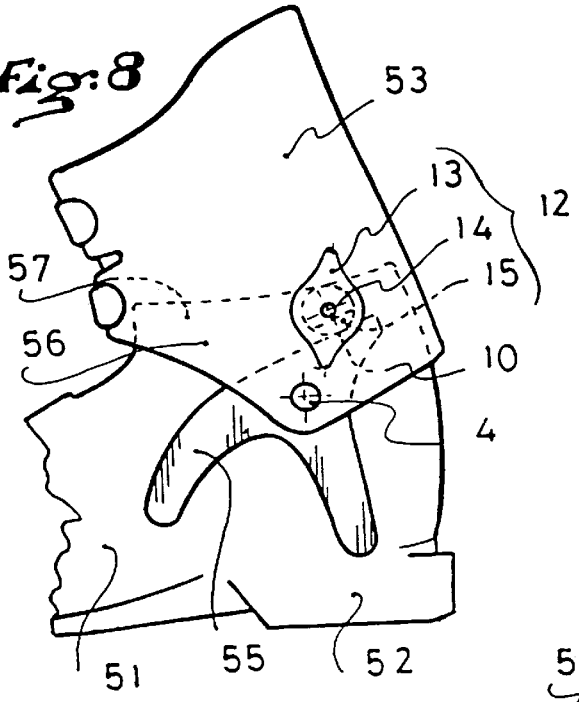
FIGS. 8 and 9 show, unlike the boots of FIGS. 1 and 2, a reinforcement and force transmission element that is active during the rearward pivoting of the upper.
Figure 9:
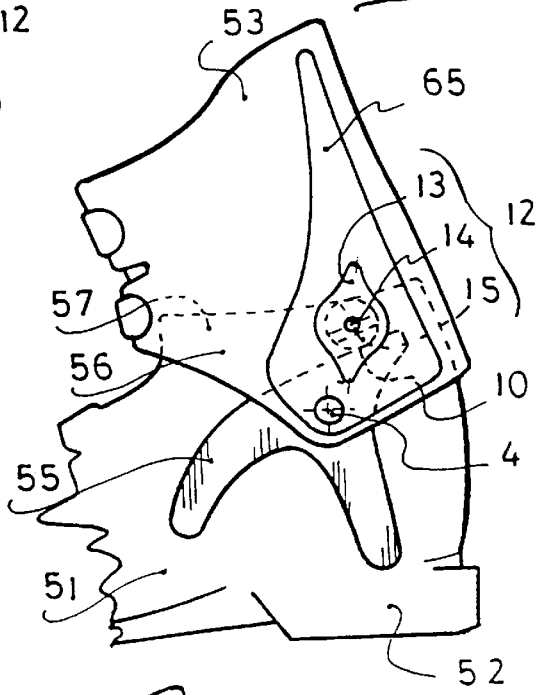

However, it is obvious that this cooperation between the abutment zone 10 and the profiled end 15 can be obtained during the pivoting of the boot in rearward bending, as is shown in FIGS. 8 and 9. In this case, the boots shown include, as described previously, a shell base 51 provided with a sole 52 and an upper 53 connected to the shell base 51 by means of a journal axle 4. The upper 53 and the shell base 51 are joined in a partial overlapping through the lower edge 56 of the upper which comes on a collar 57 of the shell base 51. The reinforcement element 55, in this example, substantially has the shape of an inverted "Y", and serves as a support for the journal axle 4 of the upper 53, as in the boot of FIGS. 1 and 2, and its abutment zone 10, projecting from or incorporated into the thickness of the wall, is oriented opposite the rearward pivoting of the upper 53. The support element 12, located across from the abutment zone 10, is thus capable of cooperating with the latter when the upper 53 tends to pivot rearwardly. Thus, depending upon whether the shoulder 15 is placed in an active position directly in contact with the abutment zone 10 or retracted by a 180° rotation of the rotating button 13, the upper 53 is blocked from any regard pivoting or free of a certain pivoting with dampening before the blockage. Indeed, due to the overlapping of the lower edge 53 of the upper 56 on the collar 57 of the shell base, frictions and elastic deformations of the portions imbricated on one another are generated which must be overcome so that the pivoting is possible until there is a contact between the shoulder 15 and the abutment zone 10.

According to the construction of the boot of FIG. 9, a reinforcement element 65 is inserted in the wall of the upper 53 and serves as a support for the support element 12. In this way, the forces and/or pressures occurring between the upper 53 and the shell base 51 are supported from the reinforcement element 65 to the reinforcement element 55 which are then coupled in their functioning during the bending of the upper 53.

Of course, the invention is not limited to the use of a reinforcement element 5, 5', 25, 35, 55, on a single flank of the shell base 1, 11, 51. Indeed, the various constructions that have just been described, opposite a flank of the boot, can also be obtained on the other flank, symmetrically or dissymetrically, depending on the characteristics that are desired for the boot. For example, in the case of a construction with symmetrical support 12, only one element can be placed in the initial active position, the profiled end 15 of the other being retracted. In this case, the upper of the boot that is subject to bending-pivoting remains blocked on one flank and can relatively deform on the other flank until the retracted end 15 is back into contact with the corresponding abutment 10. In fact, the boot upper is twisted, and as result, the forces that are applied thereto are further deviated on the flank of the boot where it is blocked. The use or non-use of one of the two reinforcement elements in a boot symmetrical structure therefore makes it possible to transmit the forces from the upper toward the shell base in a preferred direction.

Furthermore, only one reinforcement element can be provided which extends from one flank to the other of the shell base and/or of the upper, by encircling the heel and the dorsal zone, respectively, of the boot.

Finally, the retractable support element can be different from the element 12 described as an example and, in particular, can merely consist of a finger that is movable substantially perpendicular to the wall where the reinforcement element is inserted, capable of being stopped in a first position where one of its ends comes opposite the abutment zone 10, on the one hand, and in a second position where it is totally retracted from the abutment zone 10. In this mode of construction, the upper of the boot is then either blocked, or free to pivot with a certain dampening without any well defined blockage, because the support element no longer intervenes when it is completely retracted.

The instant application is based upon French Priority Application No. 96.02853, filed on Mar. 4, 1996, the disclosure of which is hereby expressly incorporated by reference thereto, and the priority of which is hereby claimed under 35 U.S.C. §119.

What is claimed:

1. A sport boot comprising:

a shell base including a collar and a sole;

an upper at least partially nesting on said shell base, said upper including a lower edge, said lower edge of said upper covering said collar of said shell base;

transversely extending journal axles connecting said upper to said shell base for enabling pivoting of said upper with respect to said shell base, said journal axles being positioned in a zone generally corresponding to an ankle a wearer of the boot;

at least one reinforcement element positioned in a lateral wall of said shell base, said reinforcement element extending from said collar of said shell base toward said sole;

said reinforcement element of said shell base having an abutment zone located beneath said lower edge of said upper;

a retractable support element positioned on said upper, said retractable support element having a profiled end for cooperating with said abutment zone of said reinforcement element for blocking said pivoting of said upper.

2. A sport boot according to claim 1, wherein:

said abutment zone of said reinforcement element projects from said lateral wall toward an exterior of said shell base.

3. A sport boot according to claim 1, wherein:

said lateral wall has a thickness and said abutment zone of said reinforcement element is located in said thickness of said wall, said wall being provided with a housing located across from said abutment zone, adapted to receive said profiled end of said retractable support element.

4. A sport boot according to claim 1, wherein:

said reinforcement element includes a determinate contour and surface area; and said reinforcement element constitutes a force directional transmitter between said upper and said shell base, whereby said reinforcement element transmits forces generated at said profiled end of said support element on said abutment zone and distributes said forces over said determinate contour and the entirety of said surface area of said reinforcement element.

5. A sport boot according to claim 4, wherein:

said reinforcement element extends forwardly on the shell base.

6. A sport boot according to claim 1, wherein:

said profiled end of said retractable support element cooperating with said abutment zone of said reinforcement element is positioned only to block forward pivoting of said upper.

7. A sport boot according to claim 1, wherein:

said profiled end of said retractable support element cooperating with said abutment zone of said reinforcement element is positioned only to block rearward pivoting of said upper.

8. A sport boot according to claim 1, wherein:

one of said transversely extending journal axles extends through said reinforcement element.

9. A sport boot according to claim 1, wherein:

said reinforcement element constitutes a single reinforcement element extending from one lateral side to a second lateral side of said shell base of the boot by encircling a heel of said shell base.

10. A sport boot according to claim 1, wherein:

said profiled end of said support element is constituted by a shoulder for cooperating with said abutment zone of said reinforcement element and movable between a first position for blocking said upper and a second position allowing for flexion of said upper.

11. A sport boot according to claim 1, wherein:

said support element comprises a button, rotatable about an axis extending substantially perpendicularly to said lateral wall of said shell base, said button having a substantially cylindrical portion, said substantially cylindrical portion having said profiled end and said shoulder.

12. A sport boot according to claim 1, further comprising:

at least one reinforcement element positioned in a wall of said upper; and wherein said retractable support element cooperates with said reinforcement element of said shell base and said reinforcement element of said upper.

13. A sport boot according to claim 1, wherein:

said at least one reinforcement element is fixed against movement in said lateral wall of said shell base.

14. A sport boot comprising:

a shell base including a collar and a sole;

an upper at least partially nesting on said shell base, said upper including a lower edge, said lower edge of said upper covering said collar of said shell base;

transversely extending journal axles connecting said upper to said shell base for enabling forward pivoting and rearward pivoting of said upper with respect to said shell base, said journal axles being positioned in a zone generally corresponding to an ankle a wearer of the boot;

at least one reinforcement element positioned in a wall of said shell base, said reinforcement element extending from said collar of said shell base toward said sole;

said reinforcement element of said shell base having an abutment zone located beneath said lower edge of said upper;

a retractable support element positioned on said upper, said retractable support element having a profiled end cooperating with said abutment zone of said reinforcement element for blocking only forward pivoting of said upper.

15. A sport boot comprising:

a shell base including a collar and a sole;

an upper at least partially nesting on said shell base, said upper including a lower edge, said lower edge of said upper covering said collar of said shell base;

transversely extending journal axles connecting said upper to said shell base for enabling pivoting of said upper with respect to said shell base, said journal axles being positioned in a zone generally corresponding to an ankle a wearer of the boot;

at least one reinforcement element positioned in a wall of said shell base, said reinforcement element extending from said collar of said shell base toward said sole, at least one of said transversely extending journal axles extending through said reinforcement element;

said reinforcement element of said shell base having an abutment zone located beneath said lower edge of said upper;

a retractable support element positioned on said upper, said retractable support element having a profiled end for cooperating with said abutment zone of said reinforcement element for blocking said pivoting of said upper.

16. A sport boot comprising:

a shell base including a collar and a sole;

an upper at least partially nesting on said shell base, said upper including a lower edge, said lower edge of said upper covering said collar of said shell base;

transversely extending journal axles connecting said upper to said shell base for enabling pivoting of said upper with respect to said shell base, said journal axles being positioned in a zone generally corresponding to an ankle a wearer of the boot;

at least one reinforcement element positioned in a wall of said shell base, said reinforcement element extending from said collar of said shell base toward said sole;

said reinforcement element of said shell base having an abutment zone located beneath said lower edge of said upper;

a retractable support element positioned on said upper, said support element comprising a button and a substantially cylindrical portion, said substantially cylindrical portion having a profiled end with a shoulder for cooperating with said abutment zone of said reinforcement element in a blocking position for blocking said pivoting of said upper, said button and said substantially cylindrical portion being rotatable about an axis extending substantially perpendicularly to said lateral wall of said shell base, between said blocking position and a retracted position, said upper being pivotal in said retracted position.

17. A sport boot comprising:

a shell base including a collar and a sole;

an upper at least partially nesting on said shell base, said upper including a lower edge, said lower edge of said upper covering said collar of said shell base;

transversely extending journal axles connecting said upper to said shell base for enabling pivoting of said upper with respect to said shell base, said journal axles being positioned in a pivot zone generally corresponding to an ankle a wearer of the boot;

said shell base including a wall, at least one reinforcement element positioned in said wall of said shell base, said reinforcement element extending from said collar of said shell base toward said sole and extending from rearward of said pivot zone to forward of said pivot zone;

said reinforcement element of said shell base having an abutment zone located beneath said lower edge of said upper;

a retractable support element positioned on said upper, said retractable support element having a profiled end for cooperating with said abutment zone of said reinforcement element for blocking said pivoting of said upper.

18. A sport boot comprising:

a shell base including a collar and a sole;

an upper at least partially nesting on said shell base, said upper including a lower portion, said lower portion of said upper covering said collar of said shell base;

a flexion zone between said upper and said shell base, whereby said upper is permitted to flex at least forwardly and rearwardly with respect to said shell base;

at least one reinforcement element positioned in a lateral wall of said shell base, said reinforcement element extending from said collar of said shell base, through said flexion zone, and toward said sole;

said reinforcement element of said shell base having an abutment zone located beneath said lower portion of said upper;

a retractable support element positioned on said upper, said retractable support element having a profiled end for cooperating with said abutment zone of said reinforcement element, said retractable support element being movable between (1) a blocking position, whereby said profiled end abuts said abutment zone of said reinforcement element for blocking at least one of forward flexing and rearward flexing of said upper, and (2) a retracted position, whereby said profiled end is retracted from abutment with said abutment zone of said reinforcement element for permitting at least one of forward flexing and rearward flexing of said upper.

19. A sport boot according to claim 18, wherein:

said flexion zone includes transversely extending journal axles connecting said upper to said shell base, said axles extending in an area corresponding to an ankle of a wearer of the boot.

20. A sport boot comprising:

a shell base including a collar and a sole;

an upper at least partially nesting on said shell base, said upper including a lower portion, said lower portion of said upper covering said collar of said shell base;

a flexion zone between said upper and said shell base, whereby said upper is permitted to flex at least forwardly and rearwardly with respect to said shell base;

at least one reinforcement element positioned in a wall of said shell base, said reinforcement element extending from said collar of said shell base, through said flexion zone, and toward said sole, said at least one reinforcement element being fixed against movement in said wall of said shell base;

said reinforcement element of said shell base having an abutment zone located beneath said lower portion of said upper;

a retractable support element positioned on said upper, said retractable support element having a profiled end for cooperating with said abutment zone of said reinforcement element, said retractable support element being movable between (1) a blocking position, whereby said profiled end abuts said abutment zone of said reinforcement element for blocking at least one of forward flexing and rearward flexing of said upper, and (2) a retracted position, whereby said profiled end is retracted from abutment with said abutment zone of said reinforcement element for permitting at least one of forward flexing and rearward flexing of said upper.

* * * * *